US010712704B2

(12) United States Patent
Matsumoto

(10) Patent No.: US 10,712,704 B2
(45) Date of Patent: Jul. 14, 2020

(54) IMAGE FORMING APPARATUS WITH VARIABLE SUPPLY OF FATTY ACID METAL SALT

(71) Applicant: FUJI XEROX CO., LTD., Tokyo (JP)

(72) Inventor: Yasutaka Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/286,626

(22) Filed: Feb. 27, 2019

(65) Prior Publication Data

US 2020/0026223 A1 Jan. 23, 2020

(30) Foreign Application Priority Data

Jul. 18, 2018 (JP) ..... 2018-135050

(51) Int. Cl.

| | |
|---|---|
| ***G03G 21/00*** | (2006.01) |
| ***G03G 15/08*** | (2006.01) |
| ***G03G 15/00*** | (2006.01) |

(52) U.S. Cl.

CPC ..... *G03G 21/0094* (2013.01); *G03G 15/08* (2013.01); *G03G 15/5008* (2013.01)

(58) Field of Classification Search

CPC .. G03G 15/167; G03G 15/08; G03G 15/0879; G03G 15/5008; G03G 21/0094; G03G 2215/00075

USPC ..... 399/252, 297

See application file for complete search history.

(56) References Cited

U.S. PATENT DOCUMENTS

| | | | | |
|---|---|---|---|---|
| 8,380,115 | B2 * | 2/2013 | Shintani | G03G 21/0011 399/346 |
| 9,280,125 | B2 * | 3/2016 | Itoh | G03G 21/0094 |
| 2008/0069614 | A1 * | 3/2008 | Shintani | G03G 21/0035 399/346 |
| 2013/0017006 | A1 * | 1/2013 | Suda | G03G 15/5008 399/346 |
| 2016/0334757 | A1 * | 11/2016 | Maehata | G03G 21/0094 |

FOREIGN PATENT DOCUMENTS

| | | | | |
|---|---|---|---|---|
| JP | 11288194 | A | * 10/1999 | |
| JP | 2003202773 | A | * 7/2003 | |
| JP | 2005274901 | A | * 10/2005 | |
| JP | 2007003730 | A | * 1/2007 | |
| JP | 2008129098 | | 6/2008 | |
| JP | 2009086579 | A | * 4/2009 | G03G 5/082 |
| JP | 2010096988 | A | * 4/2010 | |
| JP | 2012163764 | | 8/2012 | |
| JP | 2014016556 | A | * 1/2014 | |

* cited by examiner

*Primary Examiner* — Robert B Beatty
(74) *Attorney, Agent, or Firm* — JCIPRNET

(57) ABSTRACT

An image forming apparatus includes an image carrying unit that carries a toner image on a surface of the image carrying unit along with rotation of the image carrying unit to transfer the toner image onto a target transfer unit, and a supply unit that supplies a larger amount of fatty acid metal salt to the image carrying unit as a rotation speed of the image carrying unit increases.

16 Claims, 10 Drawing Sheets

IMAGE FORMING APPARATUS WITH VARIABLE SUPPLY OF FATTY ACID METAL SALT

CROSS-REFERENCE TO RELATED APPLICATIONS

This application is based on and claims priority under 35 USC 119 from Japanese Patent Application No. 2018-135050 filed Jul. 18, 2018.

BACKGROUND

(i) Technical Field

The present disclosure relates to an image forming apparatus.

(ii) Related Art

If electric discharge products adhere to the surface of an image carrying unit that carries a toner image, the electric discharge products may adsorb moisture to cause image deletion, which may lead to formation of an image with missing prints.

The electric discharge product is an active substance such as a nitrogen oxide generated through corona discharge or a reaction product thereof.

In a case of a related-art image carrying unit having an organic photosensitive layer, the surface of the image carrying unit is shaved little by little with a scraper such as a cleaning blade that scrapes smears off the surface of the image carrying unit, thereby removing electric discharge products adhering to the surface of the image carrying unit.

In recent years, an image carrying unit having a hard surface protection layer has been put into use. The surface protection layer is hard enough to resist shaving caused by the scraper. Therefore, there is little expectation that electric discharge products adhering to the surface of the image carrying unit may be removed by shaving the surface little by little. In the case of the image carrying unit having the hard surface, the following method is conceivable. A fatty acid metal salt such as zinc stearate that acts also as a lubricant is contained in an external additive for toner. By using the fact that the fatty acid metal salt has affinity for electric discharge products, the electric discharge products on the image carrying unit are adsorbed on the fatty acid metal salt and are scraped with the scraper. Alternatively, a structure including a unit that supplies the fatty acid metal salt to the image carrying unit is conceivable aside from the external additive for toner.

Japanese Unexamined Patent Application Publication No. 2008-129098 proposes that an image carrying unit is rotated in reverse prior to lubricant supply in a structure including a unit that supplies a lubricant to the image carrying unit.

Japanese Unexamined Patent Application Publication No. 2012-163764 proposes that a lubricant supply amount is adjusted depending on an outdoor temperature in a structure including a unit that supplies a lubricant to an image carrying unit.

SUMMARY

In recent years, an image forming apparatus capable of changing a process speed (a paper transport speed, a rotation speed of an image carrying unit, or the like) to a higher speed in order to increase the productivity of image formation has been put into use. When the process speed is changed to a higher speed, a phenomenon that an image defect such as missing prints is likely to occur is observed. If a large amount of fatty acid metal salt is supplied so as to constantly suppress the image defect such as missing prints irrespective of the process speed, smears are likely to develop on other members such as a charging unit.

Aspects of non-limiting embodiments of the present disclosure also relate to an image forming apparatus in which the image defect such as missing prints is suppressed irrespective of the process speed and excessive supply of the fatty acid metal salt is suppressed as well.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus comprising an image carrying unit that carries a toner image on a surface of the image carrying unit along with rotation of the image carrying unit to transfer the toner image onto a target transfer unit, and a supply unit that supplies a larger amount of fatty acid metal salt to the image carrying unit as a rotation speed of the image carrying unit increases.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure is described below.

Figure 1:
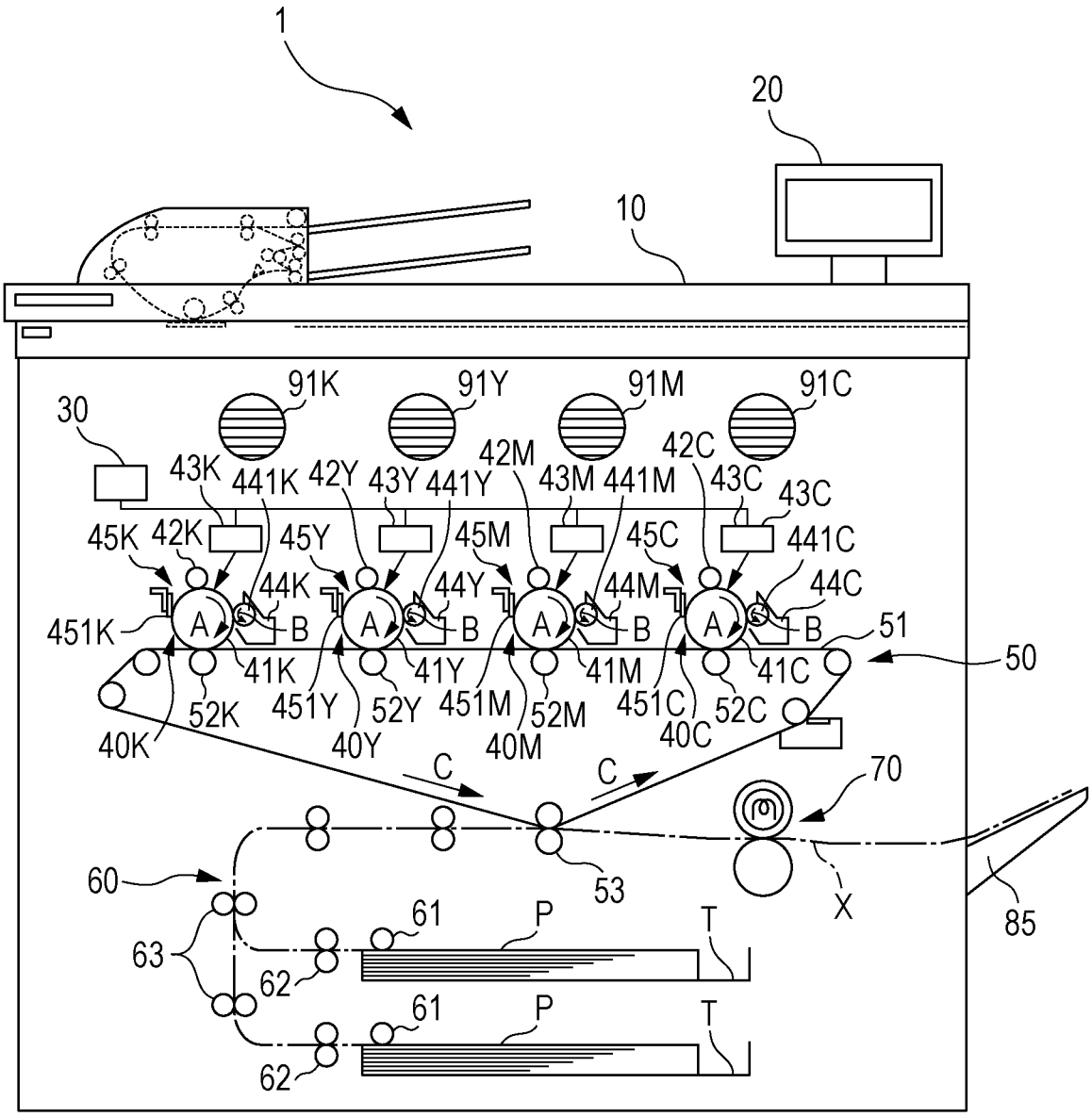
FIG. 1 is a schematic structural diagram of a copying machine corresponding to an image forming apparatus according to an exemplary embodiment of the present disclosure.

FIG. 1 is a schematic structural diagram of a copying machine corresponding to an image forming apparatus according to an exemplary embodiment of the present disclosure.

A copying machine 1 is a so-called tandem color copying machine. An image reading part 10 that reads an image from a document and a user interface (UI) 20 are provided at the top of the copying machine 1.

An image reading sensor is provided in the image reading part 10 to generate image data by reading an image of a document set on the image reading part 10.

The user interface (UI) 20 has a touch-panel display screen to receive an input of a user's operation and display various types of information for the user.

The copying machine 1 includes a main controller 30 that controls an overall operation of the copying machine 1. The main controller controls changing of a process speed and also controls the supply amount of fatty acid metal salt (for example, ZnSt) along with the changing control as matters related to the features of this exemplary embodiment. Details are described later. The main controller 30 also has a function of, for example, acquiring image data from the image reading part 10 and performing image processing on the image data.

The copying machine 1 includes four image forming engines 40C, 40M, 40Y, and 40K that form toner images of respective colors (for example, four colors that are cyan (C), magenta (M), yellow (Y), and black (K)) corresponding to pieces of image data that are sent from the main controller 30 and represent images of the respective colors, a transfer part 50 that transfers the formed toner images onto paper P, and a paper transport part 60 that transports the paper P along a transport path X.

The image forming engines 40C, 40M, 40Y, and 40K form toner images by using an electrophotographic system. The four image forming engines 40C, 40M, 40Y, and 40K have the same structure. Regarding description common to the four image forming engines 40C, 40M, 40Y, and 40K, the symbols C, M, Y, and K that represent the respective colors are omitted and a term "image forming engine 40" is used hereinafter. The same applies to constituent elements of the image forming engine 40 and other constituent elements of the copying machine 1.

The image forming engine 40 includes a cylindrical image carrier 41 that rotates in a direction of an arrow A. Along with the rotation, an electrostatic latent image is formed on the surface of the image carrier 41. The electrostatic latent image is developed with toner and a toner image is formed. The toner image is carried temporarily. The image carrier 41 has a hard surface protection layer 411 (see FIG. 3). Details of the surface protection layer 411 are described later.

The image forming engine 40 includes a charging device 42, an exposing device 43, a developing device 44, and a cleaner 45 around the image carrier 41.

The charging device 42 is a charging roller that rotates in contact with the image carrier 41. A charging bias is applied to the charging device 42 to charge the surface of the image carrier 41.

The exposing device 43 receives image data of a corresponding color from the main controller 30 and radiates modulated exposure light onto the image carrier 41 based on the received image data to form an electrostatic latent image on the image carrier 41.

The developing device 44 includes a developing roller 441 and stores developer containing toner and a carrier. The toner contains a fatty acid metal salt as an external additive.

The fatty acid metal salt is a compound obtained by substituting a metal ion for H of a fatty acid. The fatty acid is a monovalent carboxylic acid of a long-chain hydrocarbon. Examples of the metal that forms the fatty acid metal salt include zinc, lithium, sodium, magnesium, lead, and nickel. Examples of the fatty acid that forms the fatty acid metal salt include a stearic acid, a lauric acid, and a palmitic acid. Among those examples, calcium stearate, magnesium stearate, and zinc stearate are particularly preferred because the processability of an obtained transparent resin composition is excellent and the transparency is extremely excellent.

The developing roller 441 has a cylindrical shape and rotates in a direction of an arrow B. Along with the rotation, the developing roller 441 holds the developer stored in the developing device 44 on the surface of the developing roller 441 and carries the developer to a developing position where the developing roller 441 faces the image carrier 41. Then, the developing roller 441 develops the electrostatic latent image on the image carrier 41 with the toner contained in the developer.

The copying machine 1 includes a toner cartridge 91 that stores toner containing the fatty acid metal salt as the external additive. When the toner in the developing device 44 has been consumed, the developing device 44 is replenished with the toner of a corresponding color that is stored in the toner cartridge 91.

A toner image formed on the image carrier 41 through the development performed by the developing roller 441 is transferred onto the transported paper P by an action of the transfer part 50.

The toner remaining on the image carrier 41 after the transfer is scraped off the image carrier 41 by a blade 451 that constitutes the cleaner 45 and is stored in a waste toner tank (not illustrated).

The transfer part 50 includes an endless transfer belt 51 that travels in a loop in a direction of an arrow C, a first transfer device 52 that transfers the toner image from the image carrier 41 onto the transfer belt 51, and a second transfer device 53 that transfers the toner image from the transfer belt 51 onto the paper P.

Two paper trays T are arranged at the bottom of the copying machine 1. Each paper tray T stores sheets of paper P.

The paper transport part 60 includes, for each paper tray T, a pickup roller 61 that picks up sheets of paper P from the paper tray T, and handling rollers 62 that handle the sheets of paper P picked up from the paper tray T and sends one sheet of paper P onto the transport path X. The paper transport part 60 further includes many transport rollers 63 that transport the paper P along the transport path X. One of the two paper trays T from which the sheets of paper P will be picked up is selected based on the dimensions of a document set on the image reading part 10 or a user's operation performed via the UI 20.

A fixing device 70 is provided on the transport path X in the copying machine 1. A paper exit tray 85 is provided at the terminal end of the transport path X.

The fixing device 70 fixes the toner images onto the paper P where the toner images have been transferred by applying heat and pressure to the paper P with the paper P nipped by a plurality of members (for example, rotating rollers).

A basic image forming operation of the copying machine 1 is as follows. First, the user sets a document on the image reading part 10 and operates the UI 20 to give an instruction to start copying. Then, an image of the document is read by the image reading part 10 and pieces of image data are generated under control of the main controller 30. The pieces of image data obtained through the reading are sent to the main controller 30. In the main controller 30, the pieces of image data are subjected to image processing necessary for image formation, such as color separation and screening. The pieces of image data of the respective colors that have been subjected to the image processing are sent from the main controller 30 to the exposing devices 43. Electrostatic latent images corresponding to the respective colors are formed on the image carriers 41. The electrostatic latent images are developed with toner and toner images are formed. The toner images formed on the image carriers 41 are transferred so as to be superposed sequentially on the transfer belt 51 and a color toner image is formed. The color toner image is transferred onto the paper P transported by the paper transport part 60. The paper P where the color toner image has been transferred is transported along the transport path X to pass through the fixing device 70. The fixing device 70 fixes the toner image and the paper P exits onto the paper exit tray 85.

In the copying machine 1, a process speed (a paper transport speed (mm/s), a rotation speed of the image carrier (surface speed (mm/s)), or the like) is changed. The process speed is determined under control of the main controller 30 based on, for example, the type of the paper P to be used in current image formation or a user's instruction given via the UI 20 based on user's determination as to whether priority is given to image quality or to the productivity of image formation (number of sheets of paper P to be output per unit time).

In the copying machine 1 illustrated in FIG. 1, electric discharge products may adhere to the image carrier 41 due to corona discharge along with the charging performed by the charging device 42. The electric discharge product is an active substance such as a nitrogen oxide generated through corona discharge or a reaction product thereof. If the electric discharge products adhere to the surface of the image carrier 41, the electric discharge products may absorb moisture to cause image deletion, which may lead to formation of an image with missing prints. Therefore, it is necessary to remove the electric discharge products from the surface of the image carrier 41.

Figure 2A:
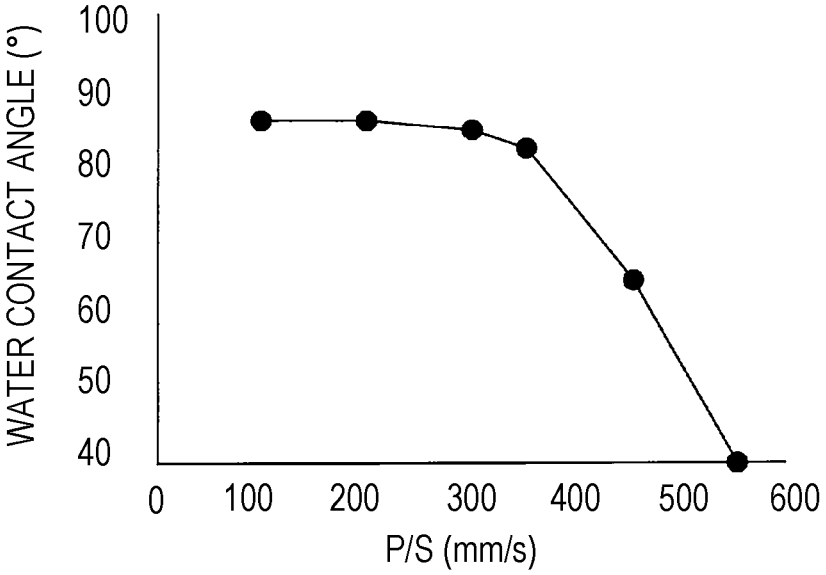
FIG. 2A illustrates a change in a water contact angle (°) with respect to a process speed.
Figure 2B:
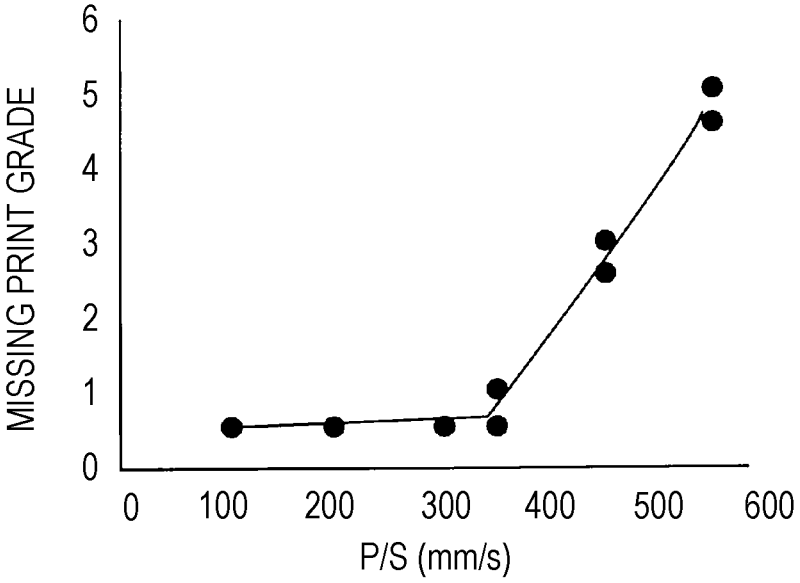
FIG. 2B illustrates a change in a missing print grade with respect to the process speed.

FIG. 2A illustrates a change in a water contact angle (°) on the image carrier with respect to the process speed. FIG. 2B illustrates a change in a missing print grade with respect to the process speed. The missing print grade illustrated in FIG. 2B indicates that the number of image defects of missing prints increases as the value of the missing print grade increases.

When the process speed increases, the water contact angle starts to change greatly around a point where the process speed exceeds 300 mm/s as illustrated in FIG. 2A. This phenomenon indicates that the electric discharge products are likely to adhere to the surface of the image carrier 41 and absorb moisture. Along with this phenomenon, the missing print grade starts to increase abruptly around a point where the process speed is 300 mm/s to 400 mm/s as illustrated in FIG. 2B. That is, the number of image defects of missing prints increases abruptly.

When the process speed increases, it is necessary to increase a charging bias potential to be applied to the charging device 42 in order to keep a constant charging potential on the image carrier 41. When the process speed increases, that is, when the charging bias potential increases, many electric discharge products are generated and the concentration of the electric discharge products increases around the charging device 42. Therefore, more electric discharge products adhere to the surface of the image carrier 41. Thus, the missing print grade increases when the process speed increases.

Figure 3:
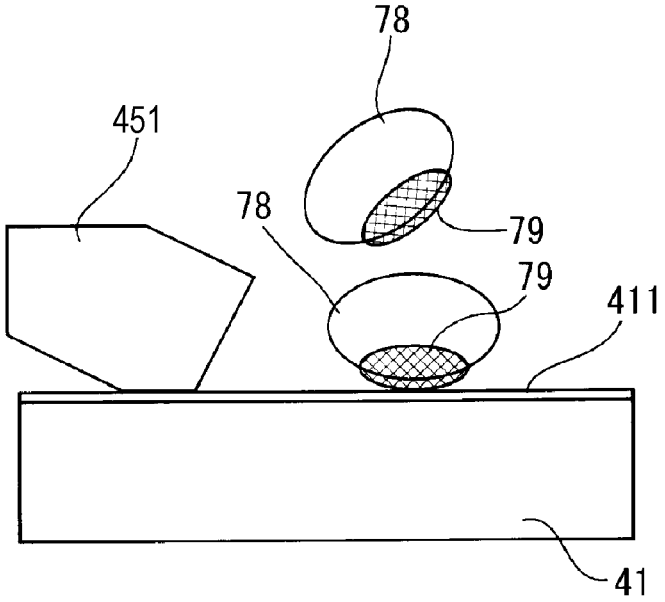
FIG. 3 illustrates a mechanism for removing electric discharge products.

FIG. 3 illustrates a mechanism for removing the electric discharge products.

In this exemplary embodiment, the toner stored in the developing device 44 and the toner stored in the toner cartridge 91 illustrated in FIG. 1 contain the fatty acid metal salt as the external additive. In this exemplary embodiment, zinc stearate (ZnSt) is used as the fatty acid metal salt. The image carrier 41 of this exemplary embodiment has the surface protection layer 411. The surface protection layer 411 has a higher hardness than a layer underlying the surface protection layer 411. The surface protection layer 411 has a property that the electric discharge products are less likely to adhere to the surface protection layer 411 than to the fatty acid metal salt. Specifically, the surface protection layer 411 of this exemplary embodiment is made of a material containing a group 13 element. More specifically, the surface protection layer 411 of this exemplary embodiment contains at least gallium and oxygen as constituent elements. The group 13 element has a property of stably incorporating hydrogen, thereby suppressing oxidation degradation.

In the case of this exemplary embodiment, an electric discharge product 79 is more likely to adhere to fatty acid metal salt 78 than to the surface protection layer 411. Therefore, the electric discharge product 79 adhering to the surface of the image carrier 41 adheres to the fatty acid metal salt 78 and is removed from the surface of the image carrier 41 with the cleaner 45 (see FIG. 1). For sufficient removal, it is desirable that a large amount of the fatty acid metal salt 78 be supplied to the surface of the image carrier 41. However, a part of the fatty acid metal salt 78 supplied to the surface of the image carrier 41 also adheres to the charging device 42. If a large amount of the fatty acid metal salt 78 adheres to the charging device 42, charging failure may occur in the image carrier 41. In view of costs, it is desirable to reduce the amount of consumption of the fatty acid metal salt 78. Therefore, it is necessary to suppress excessive supply of the fatty acid metal salt 78 to the surface of the image carrier 41. As illustrated in FIGS. 2A and 2B, the possibility of occurrence of missing prints increases as the process speed increases. Therefore, consideration is made to supply a larger amount of the fatty acid metal salt 78 as the process speed increases.

Figure 4A:
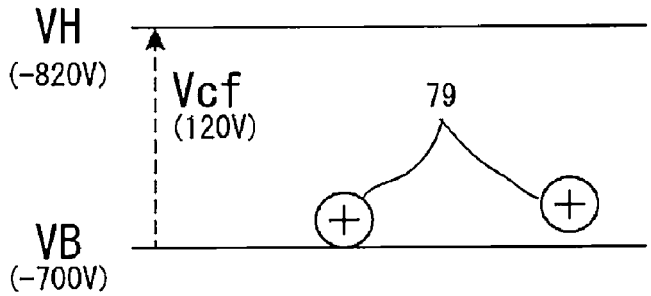
FIGS. 4A and 4B are schematic diagrams illustrating a first example of a supply unit that supplies a fatty acid metal salt to an image carrier.
Figure 4B:
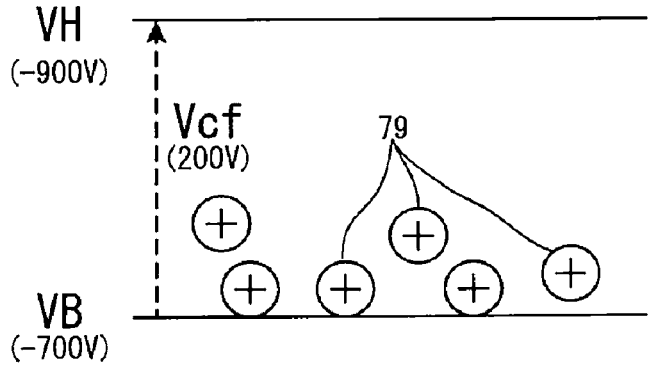

FIGS. 4A and 4B are schematic diagrams illustrating a first example of a supply unit that supplies the fatty acid metal salt to the image carrier.

The image carrier 41 is charged at a charging potential VH (for example, −820 V in FIG. 4A) by the charging device 42. A developing bias potential VB (for example, −700 V in FIG. 4A) is applied to the developing roller 441 of the developing device 44. A potential difference Vcf (in the case of FIG. 4A, 120 V) between the charging potential VH and the developing bias potential VB acts as a force for bringing the toner back to the developing device 44 so that the toner does not move to the image carrier 41. The fatty acid metal salt 78 externally added to the toner has a property that the fatty acid metal salt 78 is charged at a polarity opposite to that of a principal part of the toner. The fatty acid metal salt 78 is the external additive for the toner and generally moves together with the toner. When the potential difference Vcf between the charging potential VH and the developing bias potential VB increases as illustrated in FIG. 4B (in the case of FIG. 4B, 200 V), the amount of the fatty acid metal salt 78 that moves to the image carrier 41 away from the principal part of the toner increases. In order to increase the potential difference Vcf, the charging potential VH may be adjusted away from the developing bias potential VB while the developing bias potential VB is kept constant, the developing bias potential VB may be adjusted away from the charging potential VH while the charging potential VH is kept constant, or both the charging potential VH and the developing bias potential VB may be adjusted away from each other.

Figure 5:
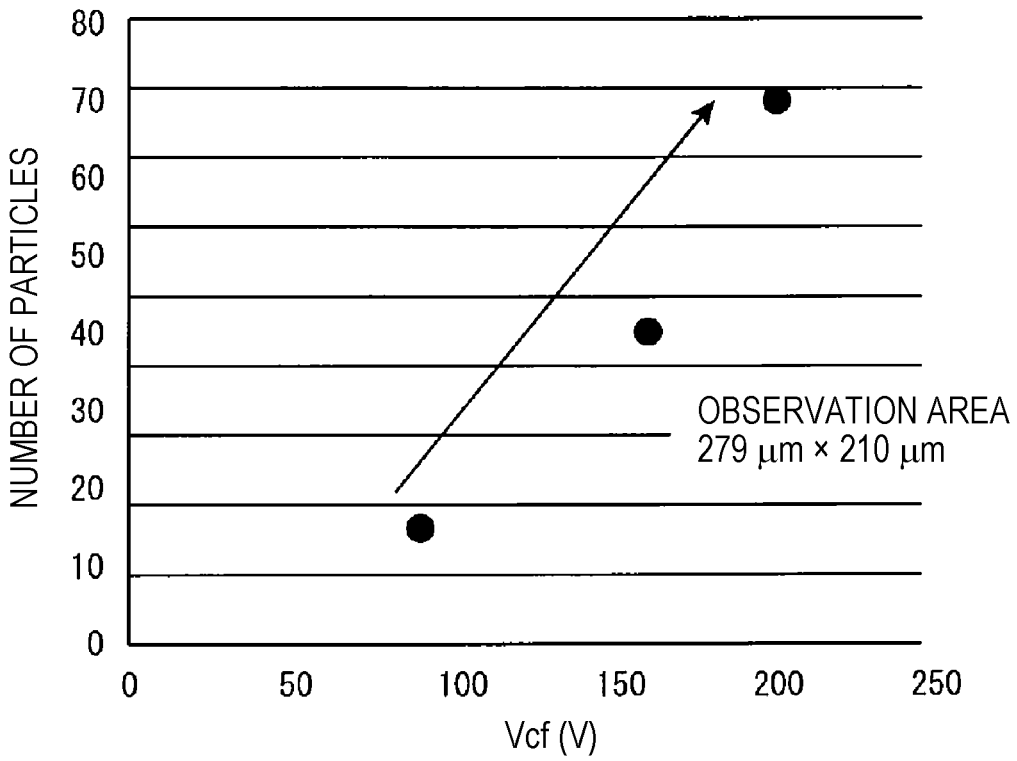
FIG. 5 illustrates the number of fatty acid metal salt particles that have moved onto the image carrier with respect to a potential difference between a charging potential and a developing bias potential.

FIG. 5 illustrates the number of fatty acid metal salt particles that have moved onto the image carrier with respect to the potential difference between the charging potential and the developing bias potential. In FIG. 5, the horizontal axis represents the potential difference Vcf (V) and the vertical axis represents the number of fatty acid metal salt particles that have moved onto the image carrier 41 within an observation area of 279 μm×210 μm.

As understood from FIG. 5, the number of fatty acid metal salt particles that move onto the image carrier 41 from the developing device 44 increases as the potential difference Vcf increases.

When the image formation is not performed, processing of setting a potential difference Vcf2 larger than a potential difference Vcf1 that is set when the image formation is performed is executed as described with reference to FIGS. 4A and 4B. Through this processing, the fatty acid metal salt is supplied to the image carrier 41. As illustrated in FIGS. 2A and 2B, the number of missing prints increases as the process speed increases. Therefore, the processing described above is also changed so that more fatty acid metal salt particles move onto the image carrier 41 as the process speed increases. Specifically, a period in which the large potential difference Vcf2 is maintained is set longer as the process speed increases. Alternatively, the potential difference Vcf2 is set larger as the process speed increases. By executing this processing, more fatty acid metal salt particles may be moved onto the image carrier 41 as the process speed increases.

As illustrated in FIGS. 2A and 2B, the missing print grade is kept low when the process speed is lower than the range of 300 mm/s to 400 mm/s. This is because the amount of the fatty acid metal salt contained in the toner and supplied to the image carrier 41 in a normal image forming process suffices unless the process speed exceeds the range of 300 mm/s to 400 mm/s.

Therefore, the processing of increasing the potential difference Vcf as described with reference to FIGS. 4A and 4B is not executed when the process speed is equal to or lower than a predetermined threshold. The processing is executed when the process speed exceeds the threshold. Further, the period in which the potential difference Vcf2 is maintained or the magnitude of the potential difference Vcf2 is adjusted so that more fatty acid metal salt particles move onto the image carrier 41 as the process speed increases. As understood from FIGS. 2A and 2B, any process speed within the range of 300 mm/s or higher and 400 mm/s or lower is adopted as the threshold. When the process speed within this range is set as the threshold, the suppression of missing prints and the suppression of excessive supply of the fatty acid metal salt are balanced.

Figure 6:
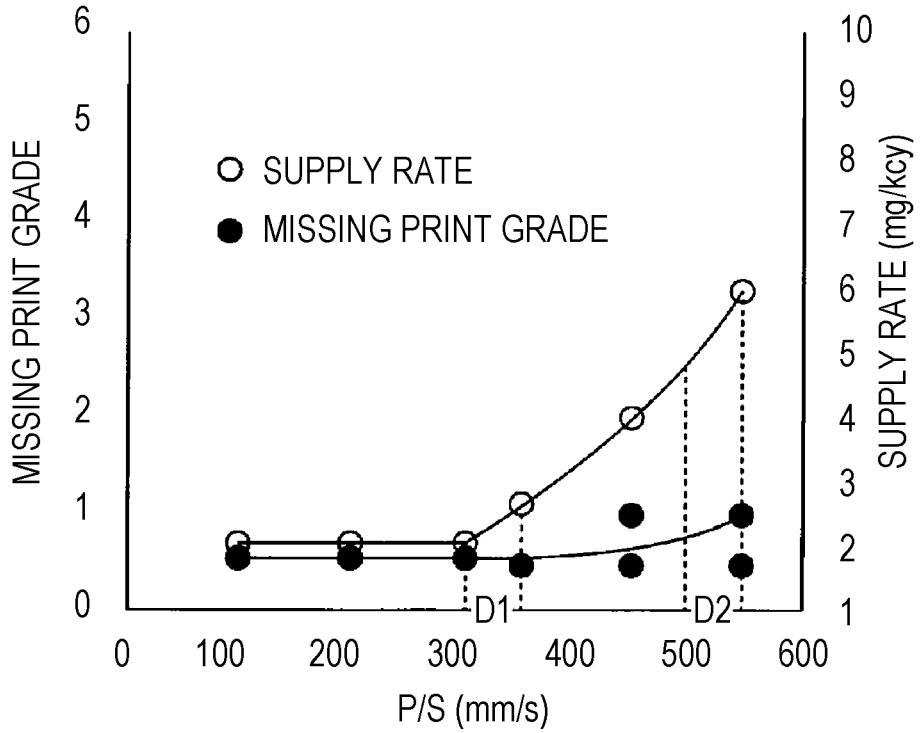
FIG. 6 illustrates a supply rate of the fatty acid metal salt and the missing print grade with respect to the process speed.

FIG. 6 illustrates a supply rate of the fatty acid metal salt and the missing print grade with respect to the process speed.

At a process speed equal to or lower than 300 mm/s, the supply rate of the fatty acid metal salt is kept constantly low. At a process speed exceeding 300 mm/s, the supply rate of the fatty acid metal salt is increased along with an increase in the process speed as illustrated in FIG. 6. Thus, the missing print grade may be kept low as illustrated in FIG. 6.

In this case, the process speed of 300 mm/s is adopted as the threshold. At a process speed exceeding the threshold, comparison is made between a range D1 of a process speed neighboring the threshold and a range D2 of a process speed higher than that in the range D1. Then, the increase rate (slope of a curve) of the supply rate of the fatty acid metal salt along with the increase in the process speed is higher in the range D2 than in the range D1. This is because the number of electric discharge products generated in the charging device 42 is substantially proportional to the process speed but the concentration of the electric discharge products around the charging device 42 is limited and the electric discharge products beyond the limit are likely to adhere to the image carrier 41.

By setting the increase rate of the supply rate of the fatty acid metal salt to be higher in the range D2 than in the range D1 as illustrated in FIG. 6, the missing prints are suppressed or the excessive supply of the fatty acid metal salt is suppressed compared with a case in which the increase amount of the process speed is proportional to the supply rate of the fatty acid metal salt at the process speed exceeding the threshold.

FIG. 6 illustrates the example in which the process speed of 300 mm/s is adopted as the threshold but substantially similar results are obtained also when the process speed of 400 mm/s is adopted as the threshold. When the process speed of 400 mm/s is adopted as the threshold, however, it is necessary to steepen the slope of the increase in the supply rate of the fatty acid metal salt at the process speed exceeding the threshold.

Other examples of the supply unit that supplies the fatty acid metal salt to the image carrier are described below.

Figure 7:
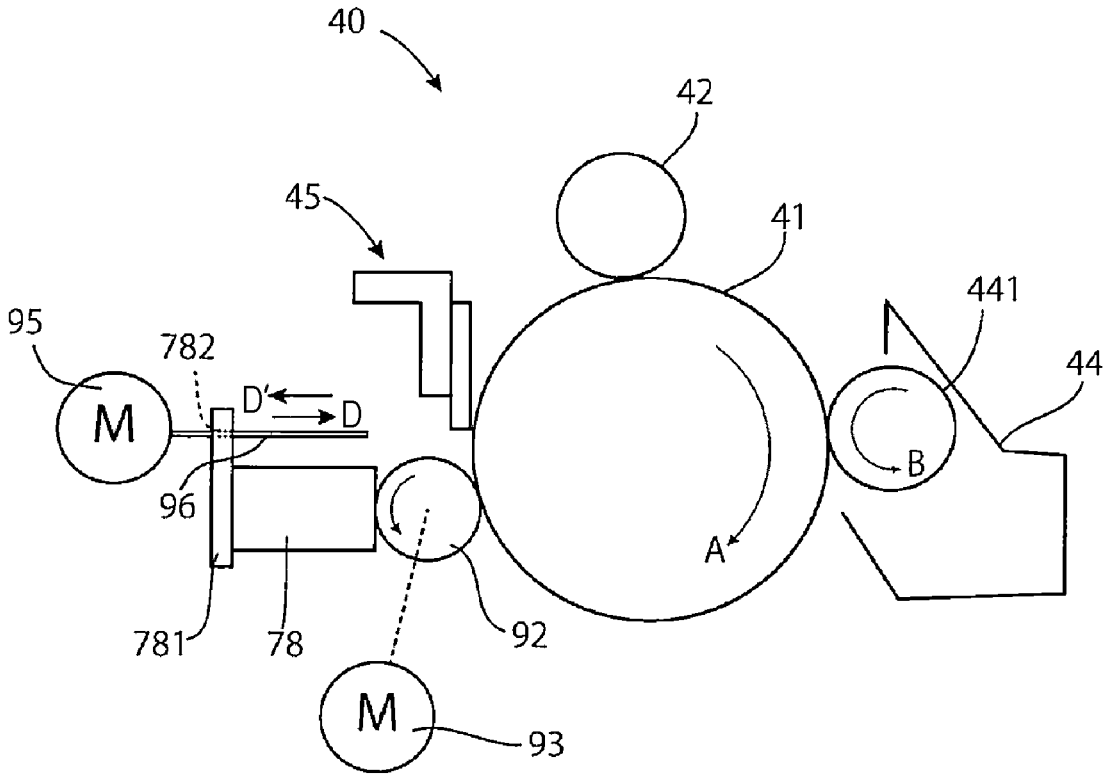
FIG. 7 is a schematic diagram of an image forming engine for description of a second example.

FIG. 7 is a schematic diagram of an image forming engine. Although the four image forming engines 40C, 40M, 40Y, and 40K are provided in FIG. 1, one representative image forming engine is illustrated in FIG. 7 while the symbols C, M, Y, and K that represent the respective colors are omitted. Illustration of the constituent elements of the image forming engine that are illustrated in FIG. 1 is partially omitted from FIG. 7 and constituent elements that are not illustrated in FIG. 1 are partially illustrated in FIG. 7. The same applies to FIG. 8 and other subsequent figures.

A second example of the supply unit that supplies the fatty acid metal salt to the image carrier is described with reference to FIG. 7.

FIG. 7 illustrates a solid fatty acid metal salt 78 and a brush 92 in contact with both the fatty acid metal salt 78 and the image carrier 41. The brush 92 is rotated by a motor 93. Along with the rotation, the brush 92 shaves the solid fatty acid metal salt 78 little by little and supplies the fatty acid metal salt 78 to the image carrier 41. The solid fatty acid metal salt 78 is supported on a support member 781. FIG. 7 also illustrates a motor 95 and a threaded rod 96. An external thread is formed on the outer periphery of the threaded rod 96. When the motor 95 rotates, the threaded rod 96 rotates together with the motor 95. The support member 781 has a hole 782 in which an internal thread is formed and through which the threaded rod 96 extends. The motor 95 is rotatable in forward and reverse directions. Since the fatty acid metal salt 78 is shaved little by little with the brush 92, the dimension of the fatty acid metal salt 78 gradually decreases. The motor 95 rotates along with the decrease in the dimension of the fatty acid metal salt 78 to move the fatty acid metal salt 78 in a direction of an arrow D. When the supply unit for the fatty acid metal salt 78 that is illustrated in FIG.

7 is provided, the fatty acid metal salt 78 may be supplied to the image carrier 41 without influence of fluctuation of the toner consumption amount due to, for example, a difference in area coverage of the toner image formed on the image carrier 41.

The motor 95 pushes the fatty acid metal salt 78 more in the direction of the arrow D as the process speed increases, thereby increasing a pressure of contact of the fatty acid metal salt 78 with the brush 92. Thus, the amount of the fatty acid metal salt 78 shaved through the rotation of the brush 92 increases and a larger amount of the fatty acid metal salt 78 is supplied to the image carrier 41. When the process speed is changed from a high speed to a low speed, the motor 95 rotates in reverse to slightly retract the fatty acid metal salt 78 in a direction of an arrow D', thereby reducing the pressure of contact of the fatty acid metal salt 78 with the brush 92. Thus, the amount of the fatty acid metal salt 78 shaved through the rotation of the brush 92 decreases and the amount of the fatty acid metal salt 78 supplied to the image carrier 41 decreases.

Alternatively, a motor that is rotatable forward to move the fatty acid metal salt 78 in the direction of the arrow D but is not rotatable in reverse may be adopted as the motor 95. In this case, the motor 95 moves the solid fatty acid metal salt 78 in the direction of the arrow D by an amount corresponding to a decrease in the dimension of the fatty acid metal salt 78. However, the motor 95 does not change the position of the fatty acid metal salt 78 depending on a change in the process speed. In this case, the rotation speed of the motor 93 that rotates the brush 92 increases as the process speed increases. That is, when the brush 92 rotates at a higher speed, the amount of the shaved fatty acid metal salt 78 increases and a larger amount of the fatty acid metal salt 78 is supplied to the image carrier 41. When the process speed is changed from a high speed to a low speed, the rotation speed of the motor 93 decreases. Thus, the amount of the fatty acid metal salt 78 shaved with the brush 92 decreases and the amount of the fatty acid metal salt 78 supplied to the image carrier 41 decreases.

Figure 8:
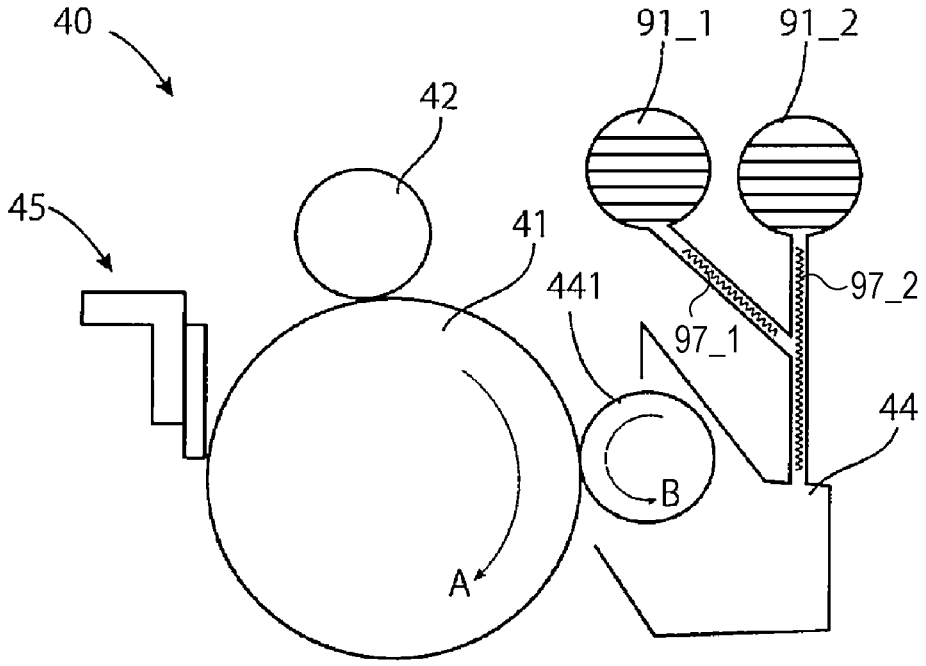
FIG. 8 is a schematic diagram of an image forming engine for description of a third example.

FIG. 8 is a schematic diagram of an image forming engine. A third example of the supply unit that supplies the fatty acid metal salt to the image carrier is described with reference to FIG. 8.

Although one toner cartridge 91 is provided in relation to the image forming engine 40 in FIG. 1, two toner cartridges 91_1 and 91_2 are provided for one image forming engine 40 in the example illustrated in FIG. 8. The two toner cartridges 91_1 and 91_2 store toners of the same color. However, the amounts of the fatty acid metal salts 78 externally added to the toners stored in the two toner cartridges 91_1 and 91_2 (the weights of the fatty acid metal salts contained in the toners per unit weight) differ from each other. That is, a small amount of the fatty acid metal salt 78 serving as the external additive is contained in the toner stored in one toner cartridge 91_1 and a large amount of the fatty acid metal salt 78 is contained in the toner stored in the other toner cartridge 91_2. The toner stored in one toner cartridge 91_1 is transported by a transport member 97_1 and is supplied to the developing device 44 while merging with the toner transported from the other toner cartridge 91_2. The toner stored in the other toner cartridge 91_2 is transported by a transport member 97_2 and is supplied to the developing device 44 while merging with the toner transported from the toner cartridge 91_1.

When the process speed is low, the ratio of the supply amount of the toner from the toner cartridge 91_1 in which the content of the fatty acid metal salt 78 is smaller is increased. When the process speed increases, the ratio of the supply amount of the toner from the toner cartridge 91_2 in which the content of the fatty acid metal salt 78 is larger is increased based on the process speed. The toner in the developing device 44 is supplied to the image carrier 41 through the developing operation. Thus, a larger amount of the fatty acid metal salt 78 is supplied to the image carrier 41 as the process speed increases. According to the third example described with reference to FIG. 8, the mixing ratio of the fatty acid metal salt in the toner to be supplied to the developing device 44 may arbitrarily be adjusted within a range of the mixing ratio of the fatty acid metal salts contained in the toners held in the two toner cartridges 91_1 and 91_2.

Figure 9:
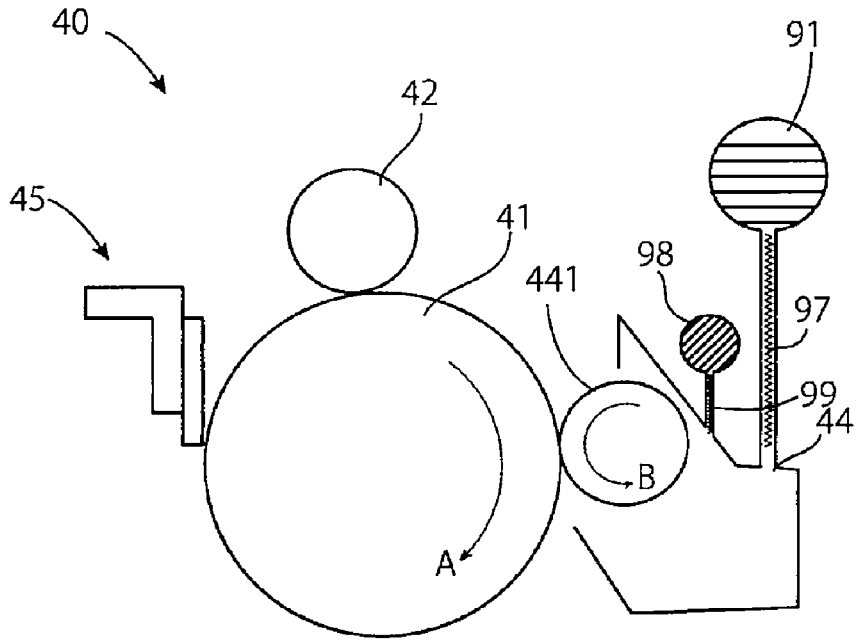
FIG. 9 is a schematic diagram of an image forming engine for description of a fourth example.

FIG. 9 is a schematic diagram of an image forming engine. A fourth example of the supply unit that supplies the fatty acid metal salt to the image carrier is described with reference to FIG. 9.

In the case of the fourth example, there is provided a fatty acid metal salt tank 98 that is not provided in the copying machine 1 of FIG. 1. The fatty acid metal salt tank 98 stores a powdery fatty acid metal salt 78. FIG. 9 illustrates that the fatty acid metal salt tank 98 is provided in relation to the image forming engine 40 but only one fatty acid metal salt tank 98 may be provided for all the four image forming engines 40 illustrated in FIG. 1. Alternatively, the fatty acid metal salt tank 98 may be provided only for one image forming engine 40 out of the four image forming engines 40 illustrated in FIG. 1.

When the toner in the developing device 44 has been consumed, the developing device 44 is replenished with the toner stored in the toner cartridge 91 by a transport member 97.

As the process speed increases, a larger amount of the fatty acid metal salt 78 is supplied from the fatty acid metal salt tank 98 to the developing device 44 by a transport member 99. The toner in the developing device 44 is supplied to the image carrier 41 through the developing operation. Thus, a larger amount of the fatty acid metal salt 78 is supplied to the image carrier 41 as the process speed increases.

Figure 10:
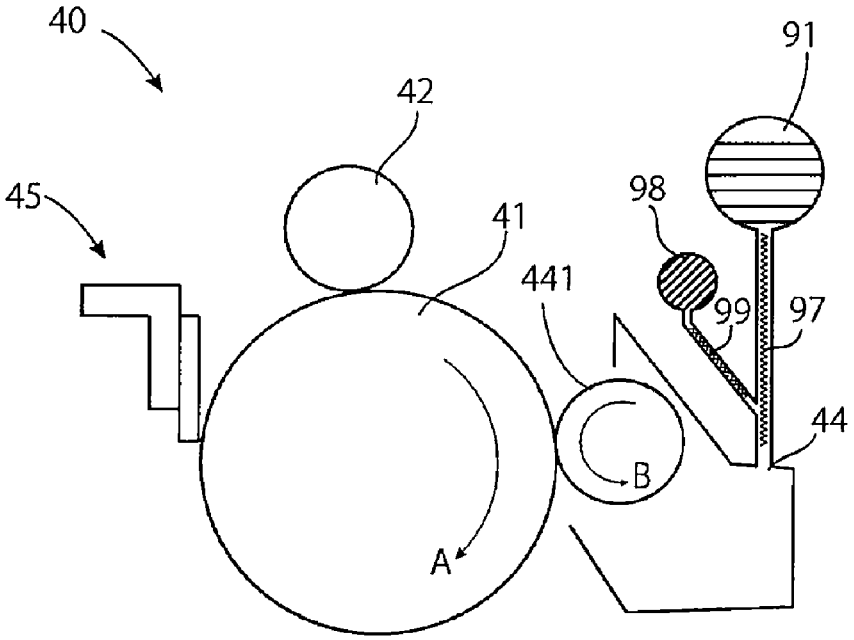
FIG. 10 is a schematic diagram of an image forming engine for description of a fifth example.

FIG. 10 is a schematic diagram of an image forming engine. A fifth example of the supply unit that supplies the fatty acid metal salt to the image carrier is described with reference to FIG. 10. The fifth example has many features in common with those of the fourth example illustrated in FIG. 9 and therefore only a difference from the fourth example is described.

In the case of the fourth example illustrated in FIG. 9, the fatty acid metal salt 78 in the fatty acid metal salt tank 98 is supplied to the developing device 44 through a transport path different from that for the toner supplied from the toner cartridge 91. In the case of the fifth example illustrated in FIG. 10, the fatty acid metal salt 78 in the fatty acid metal salt tank 98 is supplied to the developing device 44 while merging with the toner supplied from the toner cartridge 91. Thus, the developing device 44 need not have a reception port through which the fatty acid metal salt 78 is received and which is independent of a reception port for the toner. The fatty acid metal salt 78 supplied from the fatty acid metal salt tank 98 is supplied to the developing device 44 while being mixed with the toner. Thus, the fatty acid metal salt 78 supplied into the developing device 44 is evenly distributed compared with the case of the fourth example illustrated in FIG. 9.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus, comprising:

an image carrying unit that carries a toner image on a surface of the image carrying unit along with rotation of the image carrying unit to transfer the toner image onto a target transfer unit;

a supply unit that supplies a larger amount of fatty acid metal salt to the image carrying unit as a rotation speed of the image carrying unit increases;

a charging unit that charges the image carrying unit;

an exposing unit that exposes the image carrying unit to light to form an electrostatic latent image on the image carrying unit; and a developing unit that develops the electrostatic latent image formed on the image carrying unit with toner containing the fatty acid metal salt by receiving a developing bias potential applied to the developing unit, wherein the supply unit is configured to increase a supply rate of the fatty acid metal salt to the image carrying unit as the rotation speed of the image carrying unit increases, and wherein the supply unit supplies the larger amount of the fatty acid metal salt to the image carrying unit as the rotation speed increases by setting, when image formation is not performed on the image carrying unit, a potential difference between the developing bias potential and a charging potential of the surface of the image carrying unit charged by the charging unit to a first potential difference larger than a second potential difference that is set when the image formation is performed on the image carrying unit.

2. The image forming apparatus according to claim 1, wherein the supply unit supplies the fatty acid metal salt to the image carrying unit by receiving the fatty acid metal salt while being in contact with a solid fatty acid metal salt.

3. The image forming apparatus according to claim 2, wherein the supply unit supplies the larger amount of the fatty acid metal salt to the image carrying unit as the rotation speed of the image carrying unit increases by adjusting a pressure of contact of the supply unit with the solid fatty acid metal salt depending on the rotation speed.

4. The image forming apparatus according to claim 2, wherein the supply unit supplies the larger amount of the fatty acid metal salt to the image carrying unit as the rotation speed of the image carrying unit increases by adjusting, depending on the rotation speed, a time between the supply unit being in contact with the solid fatty acid metal salt and the supply unit supplying the fatty acid metal salt to the image carrying unit.

5. The image forming apparatus according to claim 1, wherein the supply unit sets a period in which the first potential difference is maintained when the image formation is not performed on the image carrying unit to be longer as the rotation speed of the image carrying unit increases.

6. The image forming apparatus according to claim 1, wherein the supply unit sets the first potential difference to be larger as the rotation speed of the image carrying unit increases.

7. The image forming apparatus according to claim 1, wherein, when the rotation speed of the image carrying unit exceeds a predetermined threshold rotation speed, the supply unit supplies the larger amount of the fatty acid metal salt to the image carrying unit as the rotation speed increases.

8. The image forming apparatus according to claim 7, wherein the threshold rotation speed is 300 mm/s or higher and 400 mm/s or lower.

9. The image forming apparatus according to claim 7, wherein the supply unit supplies the fatty acid metal salt to the image carrying unit by an amount increased so that an increase rate of the fatty acid metal salt in a first rotation speed range is higher than an increase rate of the fatty acid metal salt in a second rotation speed range at the rotation speed of the image carrying unit that exceeds the threshold rotation speed, wherein the second rotation speed range neighbors the threshold rotation speed and the rotation speed in the first rotation speed range is higher than the rotation speed in the second rotation speed range.

10. The image forming apparatus according to claim 1, wherein the image carrying unit has a surface protection layer that has a higher hardness than a layer underlying the surface protection layer and is made of a material containing an element from group 13 of the Periodic Table, and carries the toner image on a surface of the surface protection layer.

11. The image forming apparatus according to claim 10, wherein the surface protection layer contains at least gallium and oxygen as constituent elements.

12. The image forming apparatus according to claim 10, wherein the surface protection layer further contains hydrogen.

13. The image forming apparatus according to claim 10, wherein the surface protection layer has a property that an electric discharge product is less likely to adhere to the surface protection layer than to the fatty acid metal salt.

14. The image forming apparatus according to claim 1, wherein the fatty acid metal salt is zinc stearate.

15. An image forming apparatus comprising:

an image carrying unit that carries a toner image on a surface of the image carrying unit along with rotation of the image carrying unit to transfer the toner image onto a target transfer unit;

a supply unit that supplies a larger amount of fatty acid metal salt to the image carrying unit as a rotation speed of the image carrying unit increases; and a developing unit that holds toner containing the fatty acid metal salt and develops an electrostatic latent image formed on the image carrying unit with the toner, wherein the supply unit is configured to increase a supply rate of the fatty acid metal salt to the image carrying unit as the rotation speed of the image carrying unit increases, and wherein the supply unit causes the developing unit to hold toner in which a mixing ratio of the fatty acid metal salt increases as the rotation speed of the image carrying unit increases.

16. An image forming apparatus, comprising:

an image carrying means for carrying a toner image on a surface of the image carrying means along with rotation of the image carrying means to transfer the toner image onto a target transfer means;

a supply means for supplying a larger amount of fatty acid metal salt to the image carrying means as a rotation speed of the image carrying means increases;

a charging means that charges the image carrying means;

an exposing means that exposes the image carrying means to light to form an electrostatic latent image on the image carrying means; and a developing means that develops the electrostatic latent image formed on the image carrying means with toner containing the fatty acid metal salt by receiving a developing bias potential applied to the developing means, wherein the supply means is configured to increase a supply rate of the fatty acid metal salt to the image carrying means as the rotation speed of the image carrying means increases, and wherein the supply means supplies the larger amount of the fatty acid metal salt to the image carrying means as the rotation speed increases by setting, when image formation is not performed on the image carrying means, a potential difference between the developing bias potential and a charging potential of the surface of the image carrying means charged by the charging means to a first potential difference larger than a second potential difference that is set when the image formation is performed on the image carrying means.

* * * * *